US007918773B2

(12) United States Patent
Brennan et al.

(10) Patent No.: US 7,918,773 B2
(45) Date of Patent: Apr. 5, 2011

(54) PHYSICAL THERAPY REHABILITATION APPARATUS

(75) Inventors: John Brennan, Minesing (CA); Edward Charles Leach, Barrie (CA)

(73) Assignee: John Brennan, Minesing, ON (CA)

( * ) Notice: Subject to any disclaimer, the term of this patent is extended or adjusted under 35 U.S.C. 154(b) by 228 days.

(21) Appl. No.: 12/081,579

(22) Filed: Apr. 17, 2008

(65) Prior Publication Data

US 2008/0280738 A1 Nov. 13, 2008

Related U.S. Application Data

(60) Provisional application No. 60/924,381, filed on May 11, 2007.

(51) Int. Cl.
*A63B 21/04* (2006.01)

(52) U.S. Cl. ..... 482/129; 482/130

(58) Field of Classification Search ..... 482/38–40, 482/72, 121–129, 51, 92–93, 148, 44, 139, 482/91, 907–908; 446/287, 157
See application file for complete search history.

(56) References Cited

U.S. PATENT DOCUMENTS

| | | | | | |
|---|---|---|---|---|---|
| 580,420 | A * | 4/1897 | Nickerson | 482/72 |
| 1,707,791 | A * | 4/1929 | Anderson | 482/72 |
| 3,046,695 | A * | 7/1962 | Henrickson al. | 446/287 |
| 3,228,142 | A * | 1/1966 | Bahr | 446/157 |
| 3,792,860 | A * | 2/1974 | Selnes | 482/95 |
| 4,687,197 | A * | 8/1987 | Larsson et al. | 482/73 |
| 5,125,649 | A * | 6/1992 | Fuller | 482/123 |
| 5,354,251 | A * | 10/1994 | Sleamaker | 482/96 |
| 5,565,002 | A * | 10/1996 | Rawls et al. | 482/6 |
| 5,580,338 | A * | 12/1996 | Scelta et al. | 482/62 |
| 5,624,357 | A * | 4/1997 | Englehart et al. | 482/72 |
| 5,803,876 | A * | 9/1998 | Hickman | 482/72 |
| 5,820,528 | A * | 10/1998 | McAndrew | 482/72 |
| 6,106,436 | A * | 8/2000 | Lundahl | 482/1 |
| 6,328,677 | B1 * | 12/2001 | Drapeau | 482/72 |
| 6,569,065 | B1 * | 5/2003 | Menold et al. | 482/72 |
| 7,204,790 | B2 * | 4/2007 | Sleamaker | 482/96 |
| 7,335,143 | B2 * | 2/2008 | Lundahl | 482/110 |
| 2007/0015420 | A1 * | 1/2007 | Vartanian | 440/104 |
| 2008/0280738 | A1 * | 11/2008 | Brennan et al. | 482/129 |
| 2009/0280965 | A1 * | 11/2009 | Shapiro et al. | 482/72 |

OTHER PUBLICATIONS www.jacksonkayak.com Paddle Station.
www.paddlemachine.com Canoe Paddling Adapter.
www.dansprint.com Kayak ergometer.
Tony Little Easy Shaper, web address: http://www.easyshaper.com/scripts/cgiip.exe/WService=EASYSHAPER/itemdetl.html?item=Tony_Little_Easy_Shaper Jan. 18, 2011; 3 pages.

* cited by examiner

*Primary Examiner* — Lori Baker

(57) ABSTRACT

An exercise device, comprising an elongate member which has a pair of end regions with a pair of opposed end portions. Each end portion has a body wherein each body has one of a pair of opposed first end faces and at least a pair of first weighted segments. Each of the weighted segments is removably attachable to the elongate member and/or a corresponding end portion in an operative position. Each first weighted segment also has a second end face which abuts the first end face in the operative position. Each body has a first exterior surface region including and anchor portion for attaching thereto at least one elongate resilient portion at one end of the resilient portion and to a fixed object at the opposing end. A method for using the device is also provided.

17 Claims, 8 Drawing Sheets

PHYSICAL THERAPY REHABILITATION APPARATUS

REFERENCE TO CO-PENDING APPLICATIONS

The applicant claims priority benefit under Title 35,United States Code section 119(e) of U.S. Provisional application Ser. No. 60/924,381 filed May 11, 2007 and entitled PHYSICAL THERAPY REHABILITATION APPARATUS. The entire subject matter of U.S. Provisional application Ser. No. 60/924,381 filed May 11, 2007 and entitled PHYSICAL THERAPY REHABILITATION APPARATUS is incorporated herein by reference.

FIELD OF THE INVENTION

This invention relates in general to an exercise apparatus generally used for exercise, physical therapy, and/or rehabilitation.

DESCRIPTION OF THE RELATED ART

There is a wide range of exercise machines and devices that provide strength and endurance exercises that are also known as anaerobic and aerobic exercise. Previous exercise machines have been attempted to simulate the motion and effort of rowing. Exercise machines of this type are typically called "rowers" and are designed to be operated with single or multiple handles which are pulled toward the chest with reciprocating strokes in an approximate linear or curvilinear path and these motions are resisted by a resistance mechanism. For the operator, these strokes are fundamentally all pulling strokes and are intended to utilize body muscles typical of those required in actual rowing.

Because of its alternating power stroke, continuous action and focus on exercising muscles of the upper body, a kayak is known to provide a superior anaerobic and aerobic exercise. However, using an actual kayak for exercise is inconvenient for most people, because of the need for storage space and a suitable body of water.

Accordingly, it would be desirable to provide a portable exercise device for a simulated kayak-based exercise.

BRIEF DESCRIPTION OF THE DRAWINGS

Several preferred embodiments of the present invention will be provided, by way of examples only, with reference to the appended drawings, wherein.

DESCRIPTION OF THE PREFERRED EMBODIMENTS

Figure 1:
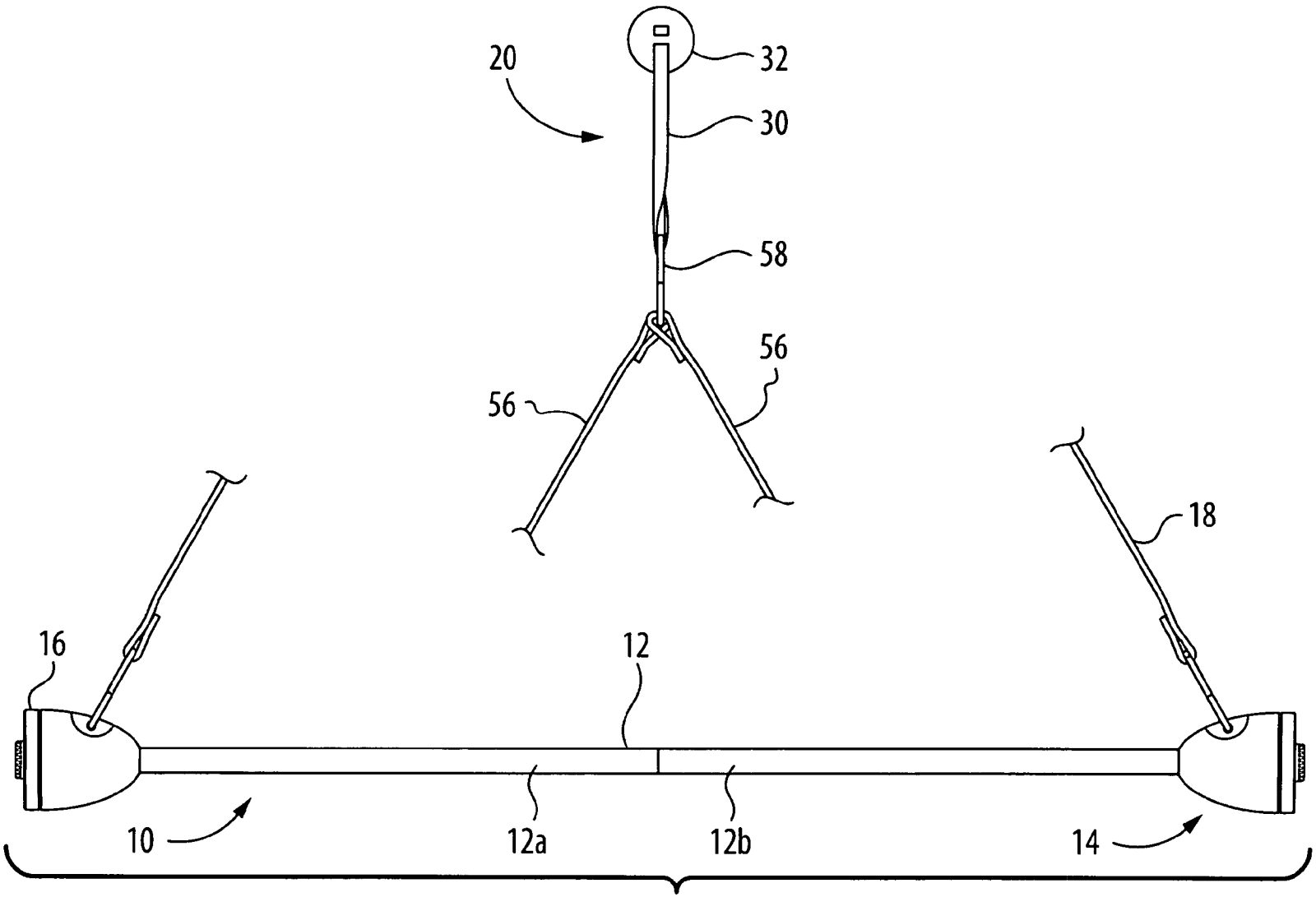
FIG. 1 is a view of is a fragmented side view of an exercise device.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention. However, other alternative mechanical configurations are possible which are considered to be within the teachings of the instant disclosure. Furthermore, unless otherwise indicated, the term "or" is to be considered inclusive.

As will expanded upon below with reference to the figures, there is provided, in an embodiment, an exercise device, comprising an elongate member, the elongate member having a pair of end regions. A pair of opposed end portions are each associated with a corresponding end region. Each end portion has a body and each body has one of a pair of opposed first end faces. At least a pair of first weighted segments is provided, each for removable attachment to the elongate member and/or a corresponding end portion in an operative position. The first weighted segment has a second end face, the first and second faces abutting one another in the operative position. Each anchor portion has a first exterior surface region and each first weighted segment has a second exterior surface region which, in the operative position, is complementary with the first exterior surface region.

The second surface region may be configured to form with the first exterior surface, a substantially continuous outer surface region, though other configurations may also be used if desired. For instance, the second surface may be larger but provide a smooth transition with the first surface, for instance.

As discussed below, an embodiment further comprises two or more elongate resilient portions, each to be joined with a corresponding body, at least one remote anchor portion to anchor the resilient portions to a fixed object, the resilient portions having a length sufficient for enabling the elongate member, in an operative position, to travel though a range of travel to enable a user to simulate a kayak paddling motion therewith.

As discussed below, an embodiment further includes anchor portion for removably securing the at least one resilient portion therewith. The anchor portion may be provided in the form of a including a cut out region formed in the body and a web centrally located therein, though anchor portions of other configurations may also be used if desired.

The weighted segment may be coupled with the end portion in a number ways, including by way of a threadably engaged with the end portion and/or the body. To this end, the body and/or the end region of the elongate member may include a first threaded projection, while the weighted segment may include a first threaded passage to engage the projection.

The projection may also include, in some examples, a second threaded passage. In this case, a threaded fastener may be associated with the weighted segment for engaging the second threaded passage for securing the first weighted segment in the operative position. The first and second passages may be provided with opposite threads as an added locking benefit.

In an embodiment, the anchor portion and/or the end portion of the elongate member include a threaded passage and a threaded fastener is associated with the weighted segment for securing the first weighted segment in the operative position.

In another embodiment, there is provided an exercise device, comprising an elongate bar, the bar having a pair of end regions, a pair of opposed end portions each associated with a corresponding end region, each end portion having a body, each body having one of a pair of opposed first end faces, a plurality of weighted segments, each for removable attachment to the bar and/or a corresponding end portion in an operative position, each body having a second end face, the first and second faces abutting one another in the operative position, each body having a first exterior surface region, each weighted segment having a second exterior surface region, the second exterior surface region being configured to be complementary with the first exterior surface region, the first end face including at least one first surface formation, each weighted segment including a second surface formation complementary with the first surface formation, in order for the weighted segment and the end portion to form a positive engagement at the abutting first and second end faces.

The first formation may include a recess and/or a projection, while the second formation including a corresponding projection and/or recess, though other formation arrangements may also be employed. As will be described below, in an embodiment, each weighted segment further comprises a third end face opposite the second end face, the third end face including a recess to receive a projection of an adjacent weighted segment.

In an embodiment, the end portion and/or the weighted segments made of ferromagnetic material and the device further comprises a holding portion for holding at least one segment in the operative position with the end portion, the holding portion including a magnet element located near one of said surface formations for drawing the end portion together with the weighted segment.

An embodiment further comprises a holding portion for holding at least one segment in the operative position with the end portion, the holding portion including a harness extending along at least a portion of the weighted segment and the end portion. The harness is removably attached to the end portion or the corresponding weighted segment and, in one example, includes a distal portion to engage a third end face on an outermost weighted segment and a plurality of straps extending from the distal portion to the end portion. The end portion may include a plurality of coupling portions for coupling with the straps, such as by the way of posts extending outwardly from the exterior surface. The end portion includes an end panel to engage the third end face and a side panel extending along a peripheral region on the outermost weighted segment.

In another embodiment, an exercise device is provided which includes an elongate bar, the bar having a pair of opposed end portions, a plurality of weighted segments, each for removable fixed installation on the end portions, each anchor portion having a first outer profile, each weighted segment having one or more second profiles which are complementary with the first outer profile to form a substantially continuous outer surface region, at least one elongate resilient member joined with each end portion, the at least one resilient member including a remote anchor portion to anchor the resilient member to a fixed object, the at least one resilient member having a length sufficient for providing the elongate bar, in an operative position, to travel though a range of travel to enable a user to simulate a kayak paddling motion therewith.

In another embodiment, there is provided a physical fitness exercising apparatus comprising at least one bar with threaded ends, a plurality of weighted members threadably engagable with the threaded ends; at least one elastic member coupled at each threaded end, the elastic member having an anchor portion to anchor the elastic member to a stationary location.

In another embodiment, there is provided an exercise device, comprising an elongate member, the elongate member having a pair of opposed end portions, a plurality of weighted segments, each for removable fixed installation on the end portions, each anchor portion having a first outer profile, each weighted segment having one or more second profiles which are complementary with the first outer profile to form a substantially continuous outer surface region, at least one elongate resilient member joined with each end portion, the at least one resilient member including a remote anchor portion to anchor the resilient member to a fixed object, the at least one resilient member having a length sufficient for providing the elongate member, in an operative position, to travel though a range of travel to enable a user to simulate a kayak paddling motion therewith.

In yet another embodiment, there is provided a physical fitness exercise comprising;

- providing a portable exercise bar and a number of weighted segments for coupling therewith;
- determining a desired weight of the bar for a predetermined physical fitness exercise;
- attaching the weighted segments to the end portions of the bar according to the desired weight;
- providing a pair of resilient band portions of sufficient length to extend between the end portions and a designated stationary location;
- anchoring each resilient band portion to the stationary location;
- coupling each resilient band portion to a corresponding end portion;
- grasping the bar; and
- extending arms outward, directing the bar in an elliptical motion to reproduce a kayak paddling motion effect.

In still another embodiment, there is provided a method of upper body physical therapy comprising:

- providing a bar having removable weighted segments and removable resistance members at its outer regions;
- providing an attachment member for the removable resistance member to provide an anchor point at an opposite location to the bar, and
- providing instructions for a user to extend their arms and to draw them toward their body in an elliptical motion to reproduce a kayak paddling motion.

In yet another embodiment, there is provided a method of upper body physical therapy for a user to exercise his/her arms, comprising;

- the user being provided with a bar;
- the user adding weighted segments to end portions of the bar to achieve a desired weight;
- the user attaching a resistance member on each end portion of the bar;
- the user anchoring a free end of each resistance member to a remote location;
- the user grasping the bar with the predetermined weight;
- with the bar in hand, the user extending the arms outward; and with the bar in hand, the user drawing the bar towards the user's body in an elliptical motion to reproduce a kayak paddling motion bar.

Referring now to the figures, particularly FIG. 1, there is provided an exercise device 10. The exercise device 10 has a bar 12. The bar 12 has end portions 14 with detachable weighted segments 16. Each of the end portions 14 is operable provide a coupling with a resilient member 18. The resilient member 18 includes an anchor portion generally shown at 20 to anchor the resilient member 18 to a fixed object.

Figure 2:
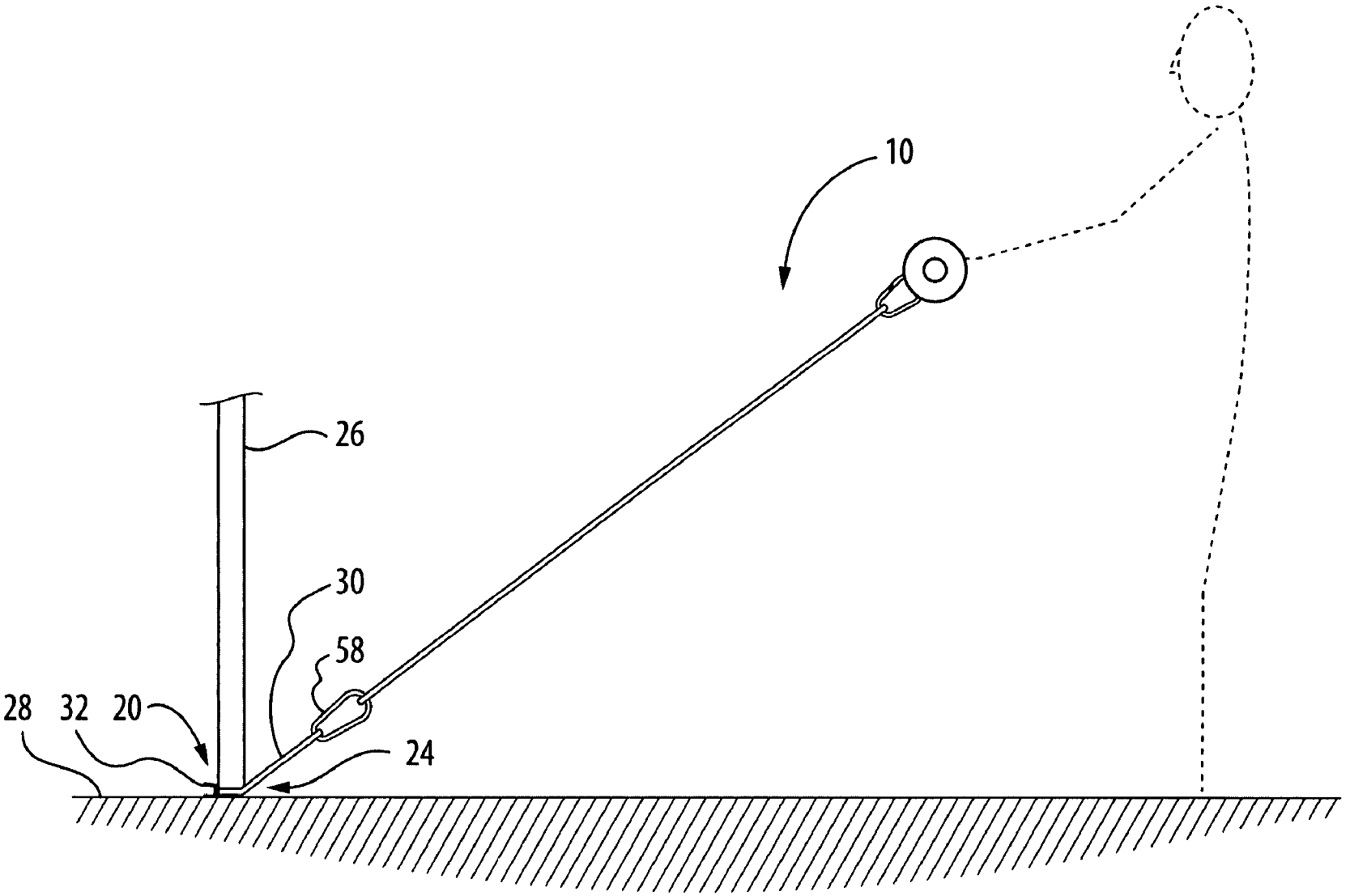
FIG. 2 is a side view of the device of FIG. 1 in an operative condition.

As shown in FIG. 2, the anchor portion 20 is operable in this example to be placed in a gap 24 between a door 26 and an adjacent surface such as, in this case, a floor 28. The anchor portion 20 includes a strap member 30 of sufficient thickness to lie in the gap 24 and a disk 32 at its remote end. In the view of FIG. 1, the disk is flexible and shown in a collapsed position adjacent the door 26 and the floor 28. The strap member 30 is of a length sufficient to extend across the gap 24.

Figure 5:
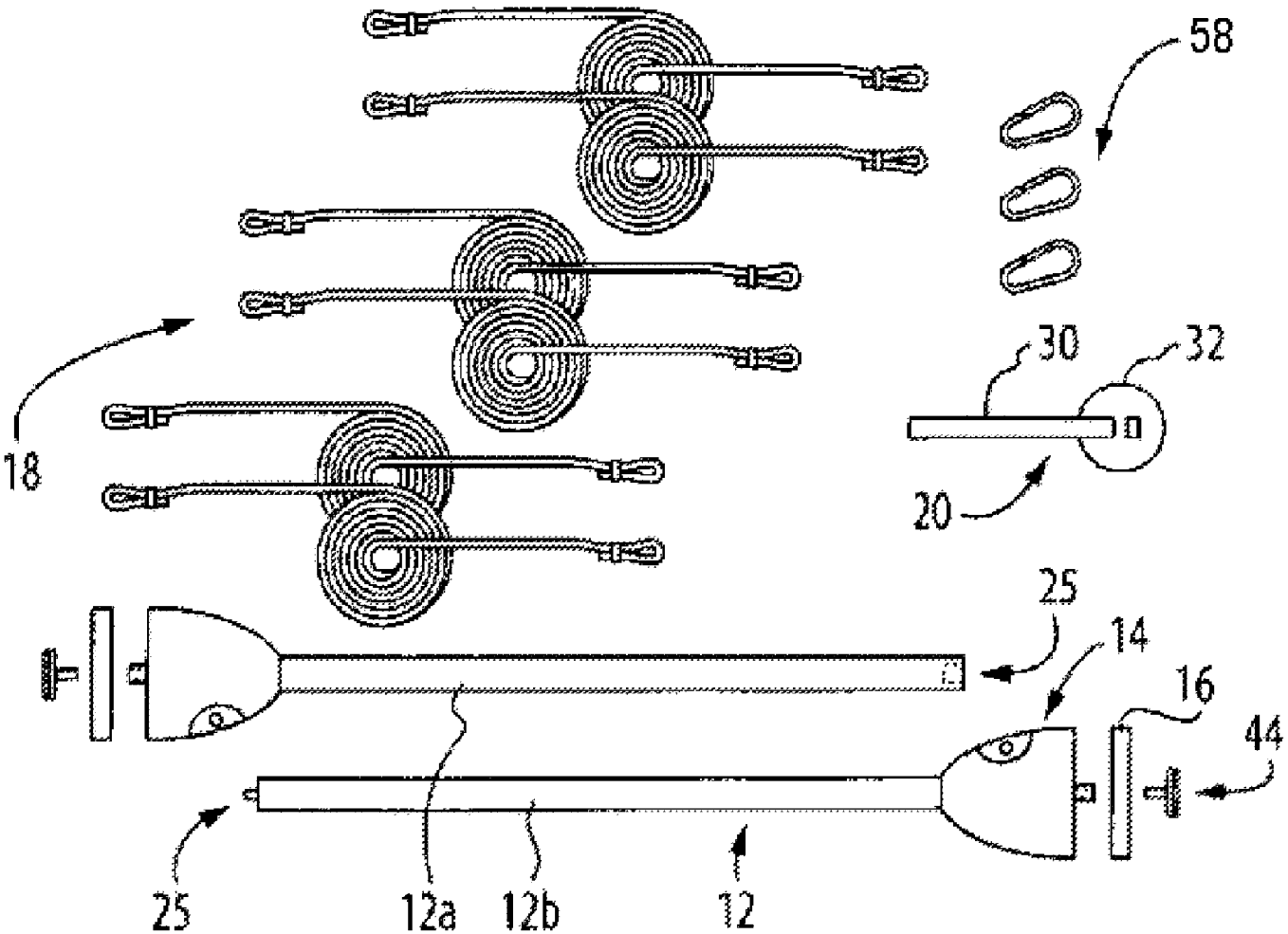
FIG. 5, is a top view of a kit for forming the device of FIG. 1.

As shown in FIGS. 1 and 5, the bar 12 comprises two sections 12*a*, 12*b* with complementary coupling portions, illustrated in FIG. 5 at 25. The complementary coupling portions 25 are threadably connectable, but other connections could be utilized for example, such as push pins, folding bar arrangements and the like.

Figure 3:
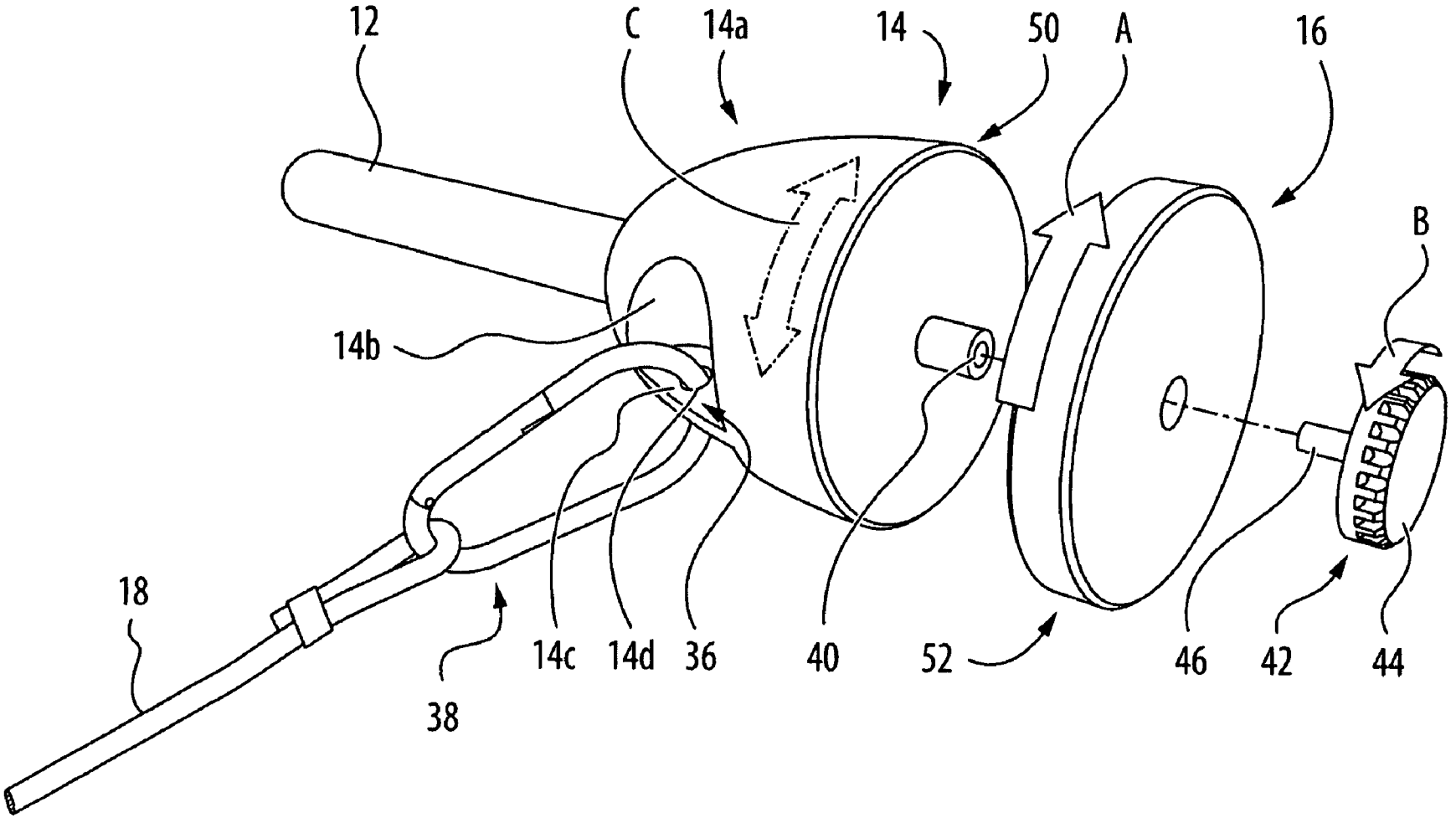
FIG. 3 is a fragmentary assembly view of a portion of the device of FIG. 1.
Figure 4:
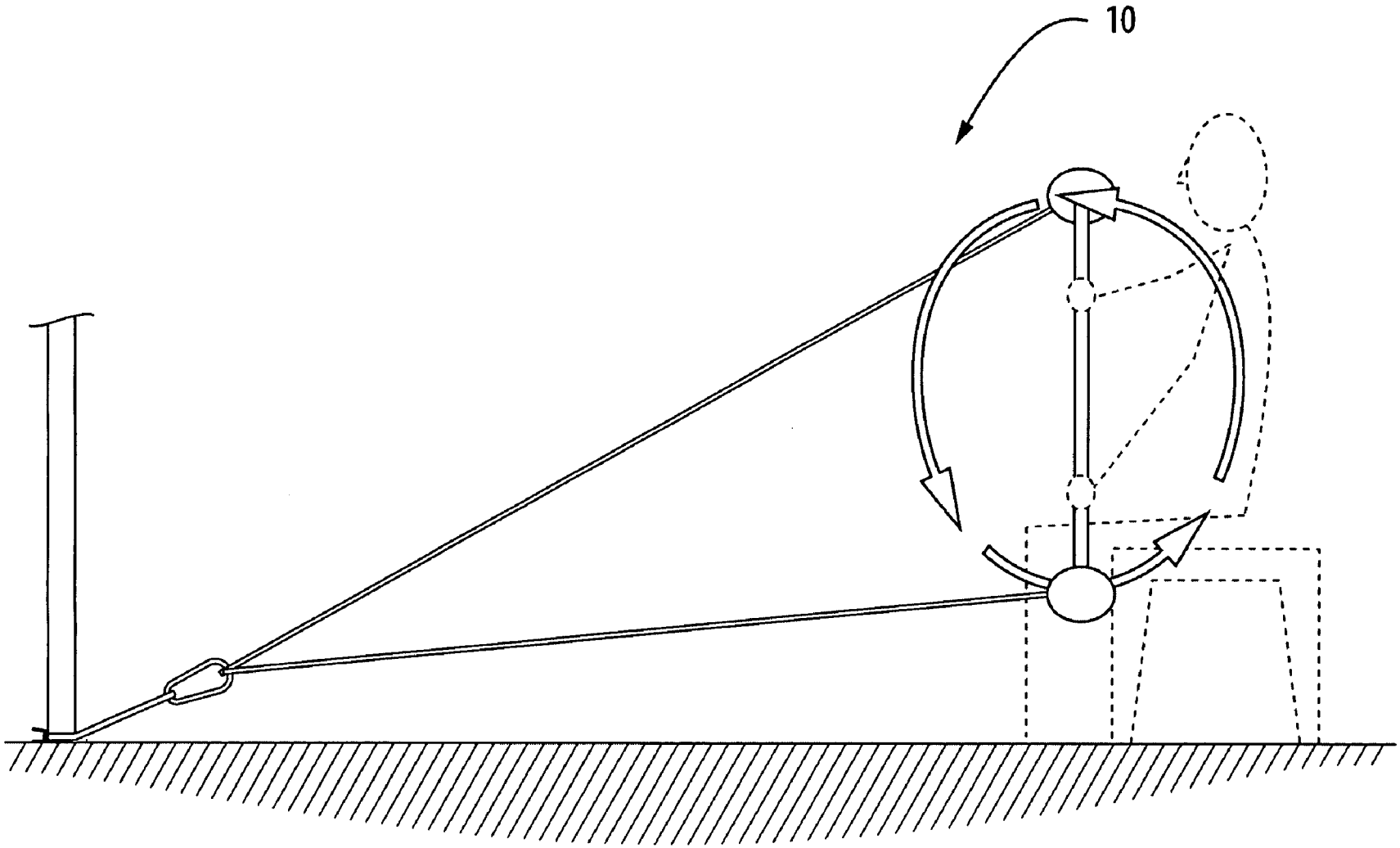
FIG. 4 is a side view of the device of FIG. 1 in another operative condition.

Referring now to FIG. 3, each end portion 14 has an anchor location 36 to receive a coupling portion 38 mounted on the resilient member 18 at an end opposite the strap member 30. In this case, the end portion 14 includes a body 14*a* which is mounted on a distal end of the bar 12. The body 14*a* has a cut out region 14*b* and the anchor location is formed by a web 14*c* extending across the cut out region with a passage 14*d* formed therein, the passage 14*d* to receive the coupling portion 38, in this case a clip which is anchored to one end of the corresponding resilient member 18.

As shown in FIGS. 3 and 5, the weighted segments 16 are threadably connected to the end portions in a first thread direction as shown by arrow A. Each end portion 14 includes an inner passage 40 to receive a lock member 42. The lock member 42 in this example is an anchor bolt 44 arrangement to threadably engage the innerpassage 40. The anchor bolt 44 arrangement includes a bolt member 46. The inner passage 40 is threaded in a second thread direction as shown by arrow B opposite the first thread direction of the end portions to maintain the weighted segment in position on the bar 12 and to prevent premature release thereof while the exercise device is in use.

Now referring to FIG. 3, each end portion 14, in this case body 14*a*, has a first profile 50 and each corresponding weighted segment 16 has a second profile 52 that is complementary with the first profile 50. Further, each weighted segment is operable to reach a fully engaged position with the end portion to form a substantially continuous outer surface therewith.

Referring to FIG. 1, the resilient member 18 includes a pair of resilient arm portions 56 coupled with the strap member 30, by way of clip member 58. This arrangement has the benefit of anchoring each resilient arm portion 56 to the clip member thus restricting the movement of the resilient member 18 through the clip member to provide a firm range of motion for the user, within the range of elasticity of the resilient member and the lateral degree of freedom of the strap member 30 when anchored in position.

Alternatively, the resilient member 18 may be slidably held within the clip member 58 as shown in FIG. 2. This provides the resilient member 18 an additional degree of movement since it can slide through the clip member, thereby allowing the movement of the bar 12 to be available through a combination of material sliding displacement and stretching of the resilient member 18.

Thus, the disk 32 provides a fixed point in which to anchor the device. The clip member 58 may be considered a fixation point in which to anchor the resilient member, either by way of a loop as shown in FIG. 2 or by a positive anchored connection of the resilient arm portions 56 as shown in FIG. 1. The fixing or anchoring function of the disk 32 may be provided in other forms, such as hook, screw fastener or the like to couple the fixed point to a suitable anchor location. The strap member 30, thus functions as or provides a span joining fixed point (the disk 32) to the fixation point (the clip member 58). In this case, the fixation point may be provided by a clip, a ring, a buckle, or for that matter, a knot, as examples.

When the fixation point is coupled to both resilient arm portions 56, as is the case in FIG. 1, the resilient member 18 may not move/slide through the fixation point, and the fixation point may swing relative to the fixed point. Thus, in the orientation of FIG. 1, the fixation point is provided with a restricted lateral movement while not being fixed in a single position, the greater the length of the strap member 30, the greater the lateral movement.

Alternatively, as shown in FIG. 2, the fixation point is slidably coupled with the resilient member, in this example formed of surgical tubing, so that the tubing may move/slide through the fixation point while the fixation point.

The exercise device 10 may be used by a person for physical therapy and/or exercise of his/her arms and shoulders in the following manner. The first step is for the user to decide if to load the weighted segments 16 or to attach the resilient member 18. If not the user then grasps the bar 12 at a pair of locations a little wider than shoulder width apart. With the bar 12 in hand, the user extends their arms outward and draws the bar 12 toward their body in an elliptical motion to reproduce a kayak paddling motion.

If desired, the user may add weighted segments 16 to each corresponding end portion to obtain a desired overall weight. The user attaches the anchor bolt 44 to make sure that the weighted segments 16 do not come off as might other wise occur by random contact between the edge of the weighted segments 16 with the floor, or by the force exerted by the kayak paddling motion. The user may then attach the resilient member 18 on each end portion of the bar 12, and then anchor the free end of each resilient member to a remote location. As described above, the user may then grasp the bar 12 in this case at locations a little wider than shoulder width. The user with the bar 12 in hand, then extends their arms outward; and draws the bar 12 towards their body in an elliptical motion again to reproduce a kayak paddling motion.

There are several alternatives to the exercise device 10 and its use. The preceding examples explain the user using one configuration to simulate the kayak paddling motion. Alternatively, the user may use more resilient members, or a bar that is not segmented. Further, the user may have a pair of smaller bars, one for each hand, each having end portions with detachable weighted segments and each being operable to couple with the resilient member and being anchored in the above mentioned motion.

The exercise device 10 may also be provided in a kit, having the bar, several weighted segments of different heaviness, which may also include resilient members of different resistance. There may be different anchor portions for use with different operative locations, for example such as a channel to engage an edge portion of a door. Another example may be to have a permanent anchor for attachment to a floor in the form of a screw and ring assembly.

In an alternative embodiment the exercise device has an elongate axis, each anchor location is operable to swivel about the elongate axis, according to bidirectional arrow C in dashed lines in FIG. 3. A further alternative embodiment is that the weighted segments have several anchor locations, as shown in dashed lines on the right hand end portion in FIG. 1, to receive the resilient members. Another example of this may involve the weighted segments having several holes to receive the coupling portions, in alternative positions.

The exercise device 10 provides, in one form, a paddle simulator that is useful for providing rehabilitation for upper body injuries, such as for recovery from shoulder injuries or surgeries. The exercise device 10 may be particularly useful for both competitive athletes and recreational water sport enthusiasts (kayak, canoe etc.), by providing, in one example, several overall health benefits of water sports like kayaking and while enhancing shoulder strengthening and endurance.

The exercise device 10 may be suitable, in some cases, as a cross training activity for the upper body even without the need to rehabilitate from an injury, by providing benefits for endurance training, core strengthening, and cardiovascular conditioning. Some of these benefits may be available, for example, in workouts spanning 10 to 15 minutes and involving approximately 1000 repetitions.

The exercise device 10 may, in some forms, present repetition advantages of spin cycling for the legs and cardiovascular system but applied to the upper body. The advantages of the device from an exercise point of view may be considered similar to swimming but more time efficient than swimming and performed in a range of motion more suitable for long term rotator cuff function than swimming and many forms of weight training or shoulder rehabilitation.

With the general aging of the baby boom generation with arthritis of the knees and hips preventing activities such as running, there would be a huge population health benefit if a suitable upper body exercise could be developed that was simple, time efficient, and effective at strengthening, cardiovascular conditioning, and weight loss. The exercise device 10 may be capable of helping to address this pressing population health issue.

Examples of possible uses of the exercise device 10 include:

1. Shoulder rehabilitation from surgery or injury.
2. Cross training activity for individual athletes seeking the upper limb and core strengthening and cardiovascular benefits.
3. Group exercise classes similar to cycling classes, Pilates etc.

Thus, the exercise device 10 may be considered portable, simple to use, and simple to produce. It may provide versatile exercise benefit that includes not only shoulder benefits but also core conditioning and cardiovascular conditioning. It may provide time efficient exercise for achieving shoulder rehabilitation. The exercise device 10 may be used in some cases to exercise all of the muscle groups using both concentric (muscle shortening) and eccentric (muscle lengthening) loading patterns.

From a rehabilitation point of view the exercise device 10 may provide feedback to the user of how the injured side is performing relative to the non injured side and encourages the user to achieve equal strength and conditioning in both the injured and non injured side.

The exercise device 10 may thus utilize one or more weights positioned at the ends of the device to have the benefit of feeling heavier (apparent weight) due to the rotational nature of the exercise and the need to accelerate the peripheral weights through a cyclical or elliptical motion, though there may be other benefits available without the need for additional weights in some cases. For example, the exerciser may experience a sensation that the harder an exerciser attempts to exercise with the exercise device 10, the exercise increases in resistance and difficulty.

The exercise device may be used in multiple postures such as sitting, standing, kneeling, sitting on an exercise ball, in lunge position with the knee up, in the lunge position with the knee down. This allows simulation of multiple types of athletic movement. For instance sitting on an exercise ball simulates the balance, core stability, and upper limb loading of kayaking. While standing with the feet together the device exaggerates the load through the core muscles and simulates the upper limb movement and core stability requirements of running.

The exercise device 10 may be seen to operate under two broad concepts:

1. The physics of circular or elliptical motion relative to straight line motion.
2. The speed, range of motion, and loading specificity of athletic achievement or musculoskeletal rehabilitation 1. The Physics of Circular or Elliptical Motion Relative to Straight Line Motion When a user lifts weights traditionally for the sake of conditioning the movement is generally a straight line or arc and the forces involved are described by Newton's second law which states that;

$$F=ma$$

Where F=force
M=mass
A=acceleration

In this situation the acceleration is described as the initial velocity of the object subtracted from the final velocity of the object divided by the time of the movement (v2−v1)/time. If an exerciser wishes to increase the resistance they need to accelerate the weight or change the amount of weight. In either case there is a linear relationship between the force and the changes. In other words if one doubles the weight then one doubles the force or if one doubles the speed of movement then one doubles the force.

If one looks at Newton's law as it applies to circular motion the relevant force equation is still F=ma but it needs to be adjusted for circular motion/acceleration. The relevant equation then becomes;

$F=v$ squared/$R$ where $v$=velocity and $R$=the radius of the movement

This equation for circular motion then becomes;

$$\text{Force}=(M4\pi^2R)/T^2$$

Where T=period of movement around the circle.

In this situation there is no longer a linear relationship between force and velocity but rather a quadratic relationship. In other words if one doubles the speed of movement one's force required for the movement increases four times. In addition it is possible to change the force by changing the radius of the movement. In the case of the exercise device 10, the weight may be relatively small, such as in the order of pounds.

However, in one example, the bodies **14*a* are strategically placed at the far ends of the bar 12** to give an increased resistance that may be varied by changing the speed of the movement or radius of the movement. The magnitude of these changes may be greater using the concept of circular motion and physics. In addition the device may be used either unrestrained so that all resistance is governed by the physics of circular or elliptical motion or it can be used with a resistance tubing yolk to create more of a directional resistance. By doing this it may be possible to recreate the forces involved in activities such as kayaking both in terms of the magnitude of the force as well as the direction of the force. Both the use of the circular motion and weight and the resistance yolk are novel approaches to upper body exercise.

2. The Speed, Range of Motion, and Loading Specificity of Athletic Achievement or Musculoskeletal Rehabilitation An aspect of athletic conditioning and rehabilitation is that it is both sport specific but more importantly specific to the force, speed, and range of motion of the desired activity. The exercise device allows flexibility to alter force, speed, and range of motion.

The exercise 10 may provide significant benefits to rotator cuff conditioning in that when using a kayaking all components of the rotator cuff as well as the prime movers of the shoulder are equally loaded. In particular the posterior rotator cuff is notoriously weak in many athletes such as swimmers, pitchers, weight lifters because they exercise predominantly with internal rotation of the shoulder and do not load the posterior rotator cuff as much or as often as the anterior elements of the rotator cuff. This leads to functional shoulder instability and often a pain syndrome. The exercise device 10 may provide equal loading of the elements of the rotator cuff both concentrically (muscle shortening) and eccentrically (muscle lengthening). In addition the exercise device 10 may provide exercise for the rotator cuff while remaining below shoulder height which is also critical for injury avoidance due to the "wringing out phenomenon" of the rotator cuff when the arm is elevated above shoulder height. The wringing out of the rotator cuff is actually the dramatically decreased blood supply or flow with shoulder abduction or elevation. By exercising the all of the rotator cuff elements equally, eccentrically, concentrically, and below shoulder the device allows for rapid conditioning and rehabilitation.

Figure 6:
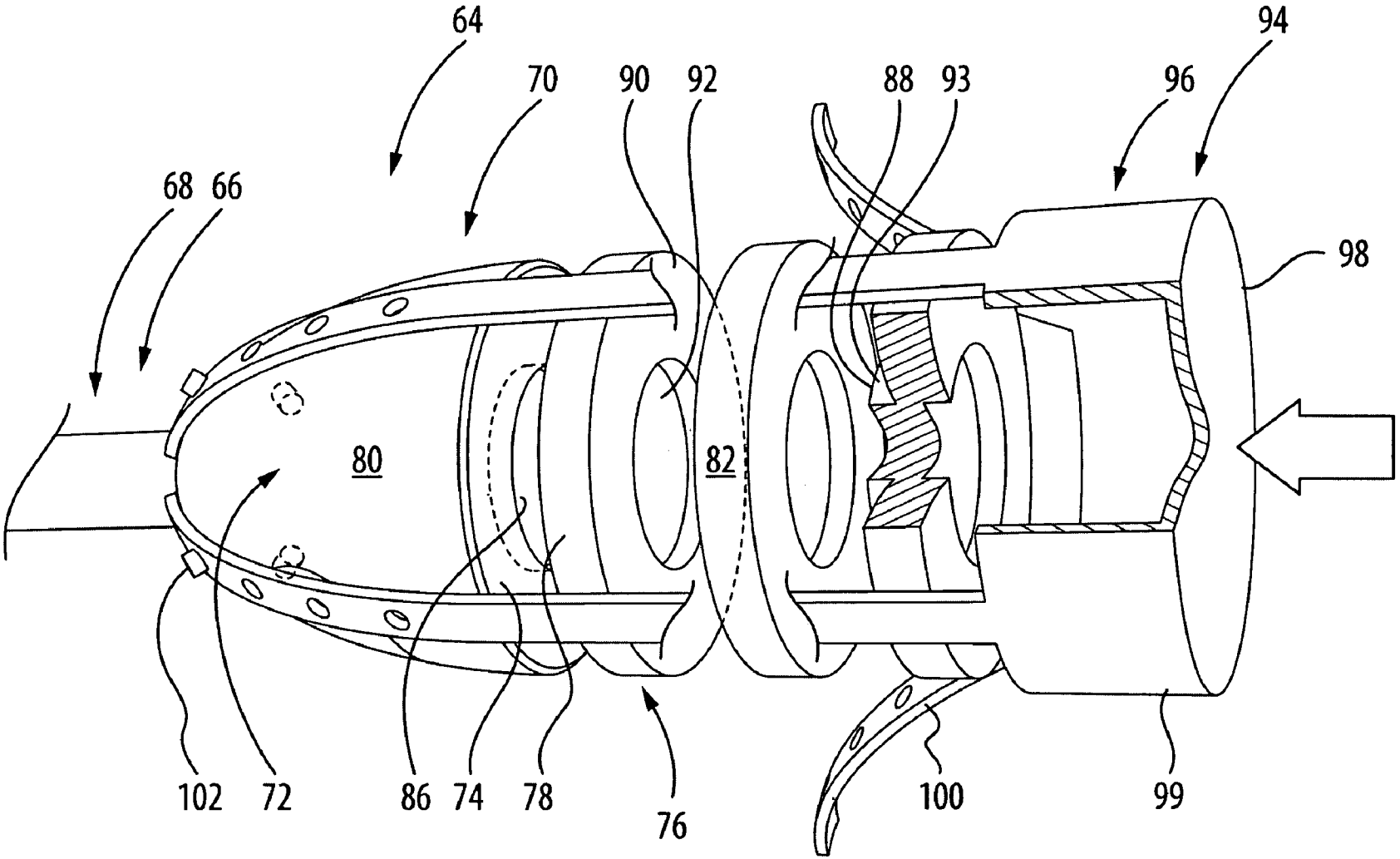
FIG. 6 is a fragmentary perspective assembly view of another exercise device.
Figure 7:
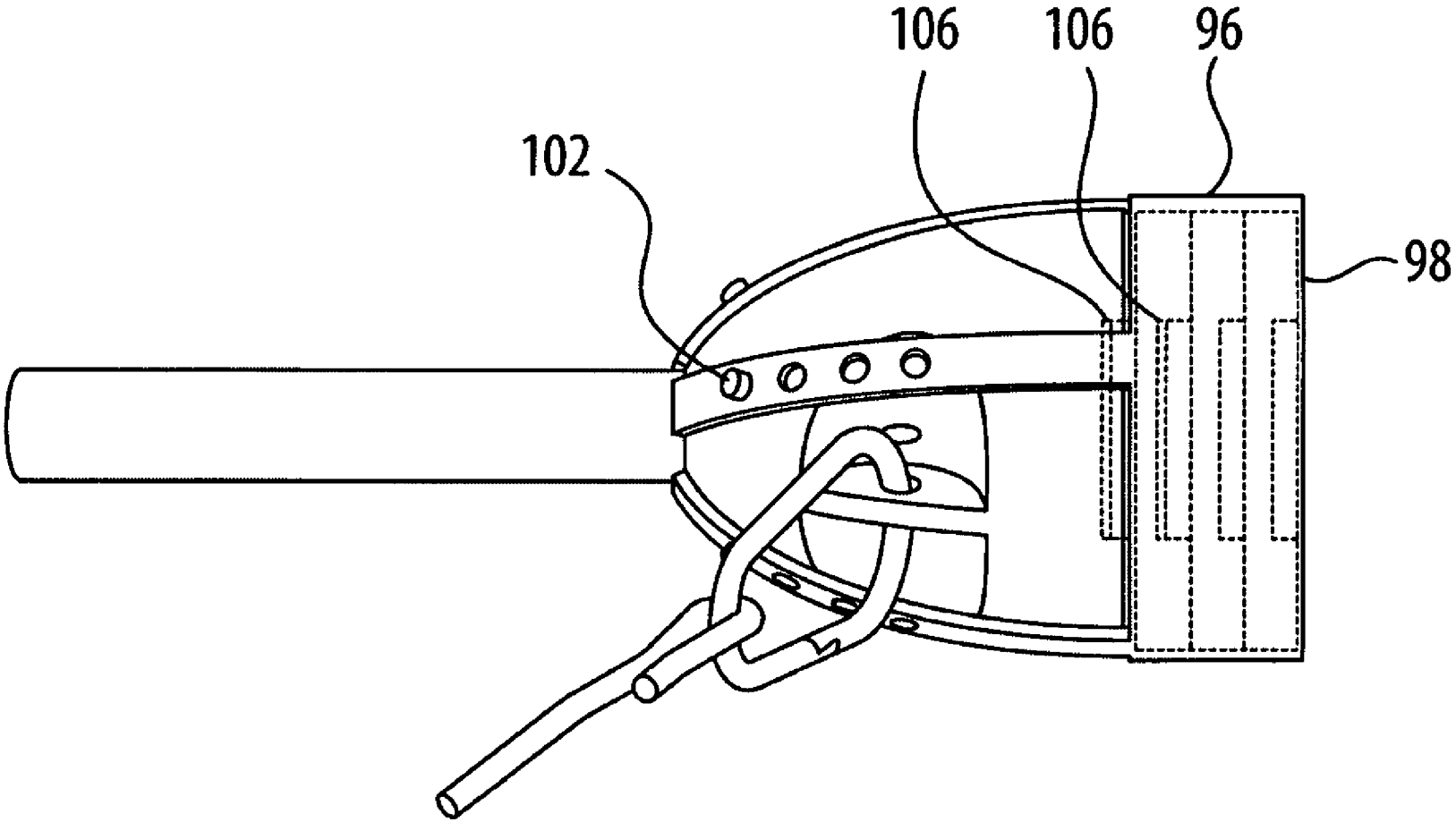
FIG. 7 is a side view of the device of FIG. 6.

Referring to FIGS. 6 and 7, there is provided another exercise device 64 having an elongate bar 66. The bar has a pair of end regions, in this case one being shown at 68. An end portion 70 is associated with an each end region 68 and each end portion has a body 72. Each body 72 has one of a pair of opposed first end faces, such as that shown at 74. As before, a plurality of weighted segments are provided at 76, each for removable attachment to the bar 66 and/or a corresponding end portion 70 in an operative position as shown in FIG. 7. Each weighted segment 76 has a second end face 78, in order that first and second faces 74, 78 may abut one another in the operative position. Each body 72 has a first exterior surface region 80. Each weighted segment 76 has a second exterior surface region 82 which is configured to be complementary with the first exterior surface region. In this case, the first and second surface regions provide a substantially continuous exterior surface profile. For example, this may mean that the first and second faces have substantially equal diameters. However, other arrangements are also contemplated. For instance, the first and second surfaces may have unequal diameters but provide a smooth transition from the first exterior surface portion to the second exterior portion as desired.

The first end face 74 includes at least one first surface formation 86 and each weighted segment 76 includes a second surface formation 88 complementary with the first surface formation 86, in order for the weighted segment and the end portion to form a positive engagement at the abutting first and second end faces. In this example, the first formation includes a recess and/or a projection, while the second formation includes a corresponding projection and/or recess.

Each weighted segment further comprises a third end face 90 opposite the second end face 88. The third end face 90 includes a recess 92 to receive a projection 93 of an adjacent weighted segment.

In the arrangement as shown in FIG. 6, there is further provided a holding portion 94 for holding at least one weighted segment 76 in the operative position with the end portion 70. In this example, the holding portion 94 includes a harness 96 extending along at least a portion of the weighted segment 76 and the end portion 70. The harness 96 is removably attached to the end portion 70 or the corresponding weighted segment 76. The harness includes a distal portion 98 to engage the third end face 90 on the outermost weighted segment, a side panel or skirt 99 extending along a peripheral region of the outermost weighted segment and a plurality of straps 100 extending from the distal portion to the end portion. The end portion 70 further includes a plurality of coupling portions for coupling with the straps 100 in the form of posts 102 extending outwardly from the first exterior surface region 80.

In another arrangement, the end portion and/or the weighted segments are made of ferromagnetic material and the holding portion, in this case, may include a magnet element (shown in two alternative locations at 106) located near one of the surface formations for drawing the end portion together with the weighted segment. If desired, the surface formations may also provide a threaded engagement therbetween to secure the weighted segments to themselves and/or to the end portion.

Thus, the device provides a means by which the weighted segments may be nested to hold in place with an anchor cap strapped to the end portion. The weights in this example are thus stackable by virtue of complementary shaping of the first and second end faces, such as by way of male or female formations. The end portion itself has a complementary receiving formation which, in this example is not threaded. Retention of the weighed member(s) may be via a rubberized hood with four point straps that are resilient and distensible. Each strap may be secured individually to the side aspect of the bar on a fixed peg emerging therefrom or using an alternative configuration, for example by providing pegs on the straps to fit with corresponding apertures in the side aspect of the bar. This configuration provides a flexibility of adding weights in small increments and maintaining the ability to fix them to the bar to achieve safety and stop movement.

Figure 8:
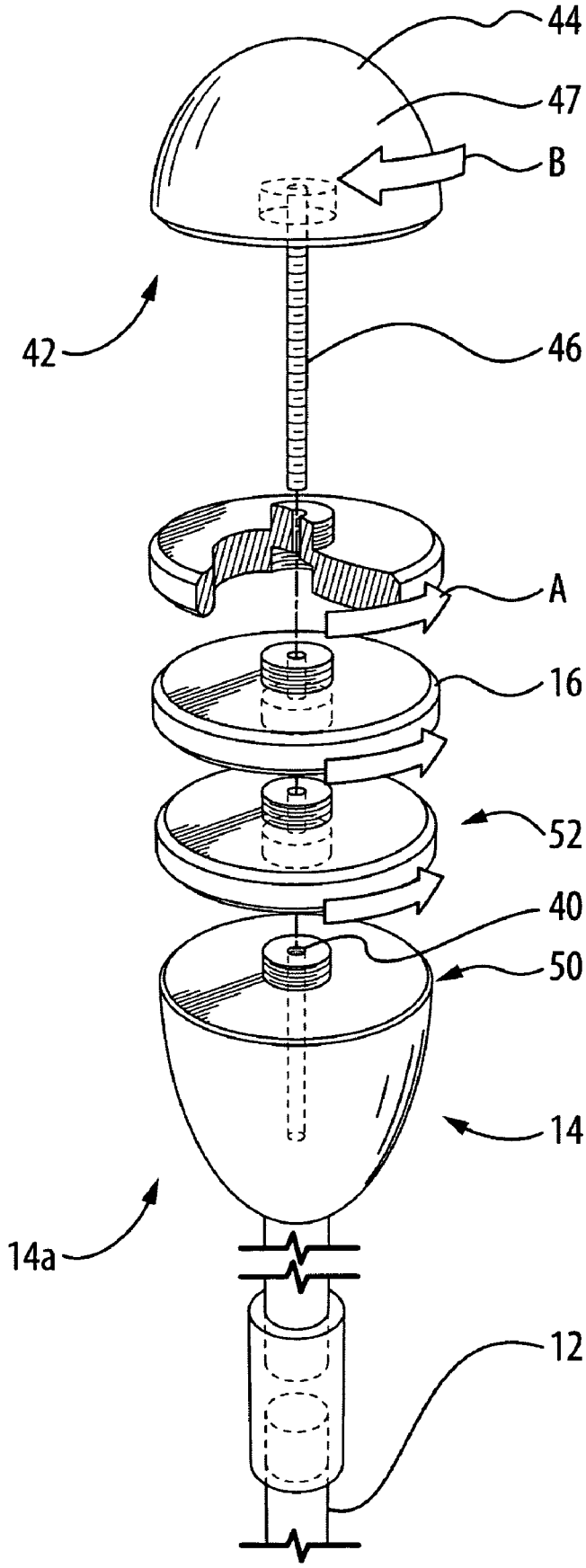
FIG. 8 is a fragmentary assembly view of a portion of another exercise device.

Referring to FIG. 8, there is provided another exercise device of similar configuration as the device of FIGS. 3 and 5. The weighted segments 16 are threadably connected to the end portions 14 in a first thread direction as shown by arrow A. Each end portion 14 includes an inner passage 40 to receive a lock member 42. The lock member 42 in this example is an anchor bolt 44 arrangement to threadably engage the inner passage 40. The anchor bolt 44 arrangement includes a bolt member 46. The inner passage 40 is threaded in a second thread direction as shown by arrow B opposite the first thread direction of the end portions to maintain the weighted segment in position on the bar 12 and to prevent premature release thereof while the exercise device is in use. In this case, the anchor bolt is further provided with an end cap portion 47 to provide a smooth finish to the outer profiles of the end portion 14 and the one or more weights 16.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An exercise device, comprising an elongate member, the elongate member having a pair of end regions, a pair of opposed end portions each associated with a corresponding end region, each end portion having a body with a first exterior surface region, each body having one of a pair of opposed first end faces, at least a pair of first weighted segments, each weighted segment for removable attachment to the elongate member and/or a corresponding end portion in an operative position, each first weighted segment having a second end face, the first and second faces abutting one another in the operative position, each of said first exterior surface regions including an anchor portion for attaching thereto at least one elongate resilient portion at one end of the resilient portion and to a fixed object at the opposing end, and each first weighted segment having a second exterior surface region which, in the operative position, is complementary with the first exterior surface region.

2. An exercise device as defined in claim 1, the second exterior surface region being configured to form with the first exterior surface, a substantially continuous outer surface region.

3. A device as defined in claim 1, wherein the resilient portions have a length sufficient for enabling the elongate member, in an operative position, to travel though a range of travel to enable a user to simulate a kayak paddling motion therewith.

4. A device as defined in claim 1, wherein the anchor portion is a cut out region formed in the first exterior surface region of the body and a web centrally located therein.

5. A device as defined in claim 4, the weighted segment being threadably engaged with the end portion and/or the body.

6. A device as defined in claim 5, the body and/or the end region of the elongate member including a first threaded projection, the weighted segment including a first threaded passage to engage the projection.

7. A device as defined in claim 6, the projection including a second threaded passage, further comprising a threaded fastener associated with the weighted segment for engaging the second threaded passage for securing the first weighted segment in the operative position.

8. A device as defined in claim 7, the first and second passages having opposite threads.

9. A device as defined in claim 6, the anchor portion and/or the end portion of the elongate member including a threaded passage, further comprising a threaded fastener associated with the weighted segment for securing the first weighted segment in the operative position.

10. A physical fitness exercise comprising; providing the exercise device as defined in claim 1 and a number of weighted segments for coupling therewith; determining a desired weight of the bar for a predetermined physical fitness exercise; attaching the weighted segments to the end portions of the bar according to the desired weight; providing at least a pair of elongate resilient band portions of sufficient length to extend between the end portions and a designated stationary location; anchoring each elongate resilient band portion to the stationary location; coupling each elongate resilient band portion to a corresponding end portion; grasping the bar; and extending arms outward, directing the bar in an elliptical motion to reproduce a kayak paddling motion effect.

11. An exercise device as defined in claim 1, the end regions and/or the weighted segments made of a ferromagnetic material, further comprising a holding portion for holding at least one weighted segment in the operative position with one end portion, the holding portion including a magnetic element located near one of the opposed faces for drawing the end portion together with the weighted segment.

12. An exercise device as defined in claim 1, further comprising a holding portion for holding at least one weighted segment in the operative position with the end portion, the holding portion including a harness extending along at least a portion of the weighted segment and the end portion.

13. An exercise device as defined in claim 11, the harness being removably attached to the end portion of the corresponding weighted segment.

14. An exercise device as defined in claim 12, the harness including a distal portion to engage a third end face on an outermost weighted segment and a plurality of straps extending from the distal portion to the end portion.

15. An exercise device as defined in claim 13, the end portion including a plurality of coupling portions for coupling with the straps.

16. An exercise device as defined in claim 14, the coupling portions including posts extending outwardly from the first exterior surface region.

17. An exercise device as defined in claim 15, the end portion including an end panel to engage the third end face and a side panel extending along a peripheral region on the outermost weight segment.

* * * * *